US008002377B2

(12) United States Patent
Kogure et al.

(10) Patent No.: US 8,002,377 B2
(45) Date of Patent: Aug. 23, 2011

(54) IMAGE FORMING APPARATUS

(75) Inventors: Seiichi Kogure, Yamato (JP); Yoichi Ito, Komae (JP)

(73) Assignee: Ricoh Company, Ltd., Tokyo (JP)

( * ) Notice: Subject to any disclaimer, the term of this patent is extended or adjusted under 35 U.S.C. 154(b) by 503 days.

(21) Appl. No.: 12/189,413

(22) Filed: Aug. 11, 2008

(65) Prior Publication Data

US 2009/0058911 A1 Mar. 5, 2009

(30) Foreign Application Priority Data

Aug. 10, 2007 (JP) ..... 2007-208806

(51) Int. Cl.
*B41J 29/38* (2006.01)

(52) U.S. Cl. ..... 347/16; 347/104; 347/105

(58) Field of Classification Search ..... 347/16, 347/101, 104, 105
See application file for complete search history.

(56) References Cited

U.S. PATENT DOCUMENTS

| | | | | |
|---|---|---|---|---|
| 5,133,616 | A * | 7/1992 | Oyaide et al. | 400/635 |
| 6,575,459 | B1 | 6/2003 | Kakiwaki et al. | |
| 7,334,858 | B2 | 2/2008 | Kogure et al. | |
| 7,334,890 | B2 * | 2/2008 | Nakamura | 347/104 |
| 7,530,449 | B2 * | 5/2009 | Nakashima et al. | 198/810.03 |
| 7,891,805 | B2 * | 2/2011 | Imoto et al. | 347/104 |
| 2001/0040616 | A1 * | 11/2001 | Uchida | 347/104 |
| 2006/0055754 | A1 | 3/2006 | Sakuma et al. | |
| 2006/0164491 | A1 | 7/2006 | Sakuma et al. | |
| 2006/0181589 | A1 * | 8/2006 | Nishida | 347/104 |
| 2006/0187289 | A1 * | 8/2006 | Nakashima | 347/104 |
| 2006/0279621 | A1 | 12/2006 | Morohoshi | |
| 2007/0103532 | A1 | 5/2007 | Imoto et al. | |
| 2007/0109385 | A1 | 5/2007 | Imoto et al. | |
| 2008/0218578 | A1 * | 9/2008 | Ishihara et al. | 347/104 |

FOREIGN PATENT DOCUMENTS

| | | | |
|---|---|---|---|
| EP | 1060897 | A2 | 12/2000 |
| JP | 2002-284383 | | 10/2002 |
| JP | 2004-131197 | | 4/2004 |
| JP | 2005-170624 | | 6/2005 |
| JP | 2006-52033 | | 2/2006 |
| JP | 2007-21918 | | 2/2007 |
| JP | 2007-299987 | | 11/2007 |
| WO | WO2004/108419 | A1 | 12/2004 |

OTHER PUBLICATIONS

Oct. 28, 2008 search report in connection with a counterpart European patent application No. 08 25 2652.

* cited by examiner

*Primary Examiner* — Daniel Petkovsek
(74) *Attorney, Agent, or Firm* — Cooper & Dunham LLP

(57) ABSTRACT

An image forming apparatus includes a print head, an endless belt, a pressure roller, and a controller. The print head is configured to eject droplets of ink from multiple nozzles onto a recording sheet. The endless belt is stretched around at least first and second rollers, and is configured to convey the recording sheet placed on an outer surface thereof. The pressure roller is configured to exert pressure against the outer surface of the endless belt. The controller is configured to move the endless belt into a correcting position where the pressure roller meets a given portion of the endless belt. The given portion of the endless belt is previously retained in contact with the first roller and develops deformation due to the previous retention. The pressure exerted by the pressure roller corrects the deformation while the endless belt is in the correcting position.

17 Claims, 14 Drawing Sheets

IMAGE FORMING APPARATUS

TECHNICAL FIELD

This patent specification relates to an image forming apparatus, and more particularly, to an image forming apparatus that forms an image by ejecting droplets of ink from a print head onto a recording medium, capable of correcting local deformation of a media transport belt used to convey the recording medium.

DISCUSSION OF THE BACKGROUND

Recently, inkjet printing systems have come to be widely used in various image forming apparatuses, such as printers, facsimiles, photocopiers, and multifunctional machines having image forming capabilities. In particular, an inkjet printer includes a print head to form an ink image by ejecting droplets of ink onto a recording medium or recording sheet conveyed by a media transport mechanism throughout the printing process.

In some inkjet printers, the media transport mechanism is implemented as an endless transport belt supported by and tensioned around multiple rollers defining a travel path of the recording medium. As the supporting rollers rotate, the transport belt moves along the travel path while conveying thereon a recording sheet through a print zone, i.e., beneath the print head, where ink droplets ejected from the print head land on the conveyed recording sheet.

In order for ink droplets to land at desired locations of the recording sheet, it is important to maintain a consistent gap between the conveyed sheet and the print head. Achieving good flatness of a recording sheet during printing is therefore highly required in such inkjet printers, while not so in a laser printer which transfers an image onto a recording sheet by direct contact with a photoconductive surface. For this reason, media transport used in an inkjet printer is typically equipped with a source of suction or electrostatic force to attract the recording sheet onto the moving belt and maintain it in a flat, stable condition.

One problem that affects belt-based media transport systems is local deformation of the transport belt occurring under certain usage conditions. That is, when a transport belt is held stationary under tension for extended time periods, a portion of the belt remaining in contact with the supporting roller conforms to the curve of the roller surface, arching outwardly from a normal position and maintaining that curve even after separating from the roller. Such belt deformation is known to adversely affect the imaging performance of the inkjet printer using the belt transport.

To take a specific example, as the transport belt rotates and a local deformation is advanced to the print zone upon such rotation of the transport belt, the outward arch of the deformation might accidentally contact an ink ejecting face of the print head. Moreover, a recording sheet conveyed on such an outward deformation is occasionally displaced from the belt surface to undesirably interfere with the print head in the print zone. Such interference between the sheet and the print head leads to various printing defects, such as sheet misalignment or paper jam and improper placement of ink droplets on the sheet, which degrade imaging quality of the image forming apparatus.

To cope with the belt deformation of the media transport, various techniques have been proposed.

For example, one conventional method proposes a chargeable transport belt with electrode arrays implanted on a back side thereof. The backing electrode arrays provide increased electrostatic force to firmly attract a recording sheet onto the transport belt. Another conventional method provides a transport belt with a source of variable attraction force, which exerts a relatively large force when a recording sheet is conveyed in an abnormal condition.

These conventional techniques are designed to stabilize media transport with a transport belt, and although capable of avoiding defects caused by a damaged belt, do not provide a fundamental solution to the problem, namely, one that can correct belt deformation. It is therefore advantageous to have a belt transport system that can correct local deformation of a transport belt, achieving reliable conveyance of material without interfering with neighboring components. An inkjet printer having such a belt transport will provide enhanced imaging quality with stable ink ejecting performance.

BRIEF SUMMARY

This disclosure describes a novel image forming apparatus that forms an image by ejecting droplets of ink from a print head onto a recording medium, capable of correcting a deformation of a media transport belt used to convey the recording medium.

In one aspect of the disclosure, the novel image forming apparatus includes a print head, an endless belt, a pressure roller, and a controller. The print head is configured to eject droplets of ink from multiple nozzles onto a recording sheet. The endless belt is stretched around at least first and second rollers, and is configured to convey the recording sheet placed on an outer surface thereof. The pressure roller is configured to exert pressure against the outer surface of the endless belt. The controller is configured to move the endless belt into a correcting position where the pressure roller meets a given portion of the endless belt. The given portion of the endless belt is previously retained in contact with the first roller and develops deformation due to the previous retention. The pressure exerted by the pressure roller corrects the deformation while the endless belt is in the correcting position.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF EXEMPLARY EMBODIMENTS

Figure 1:
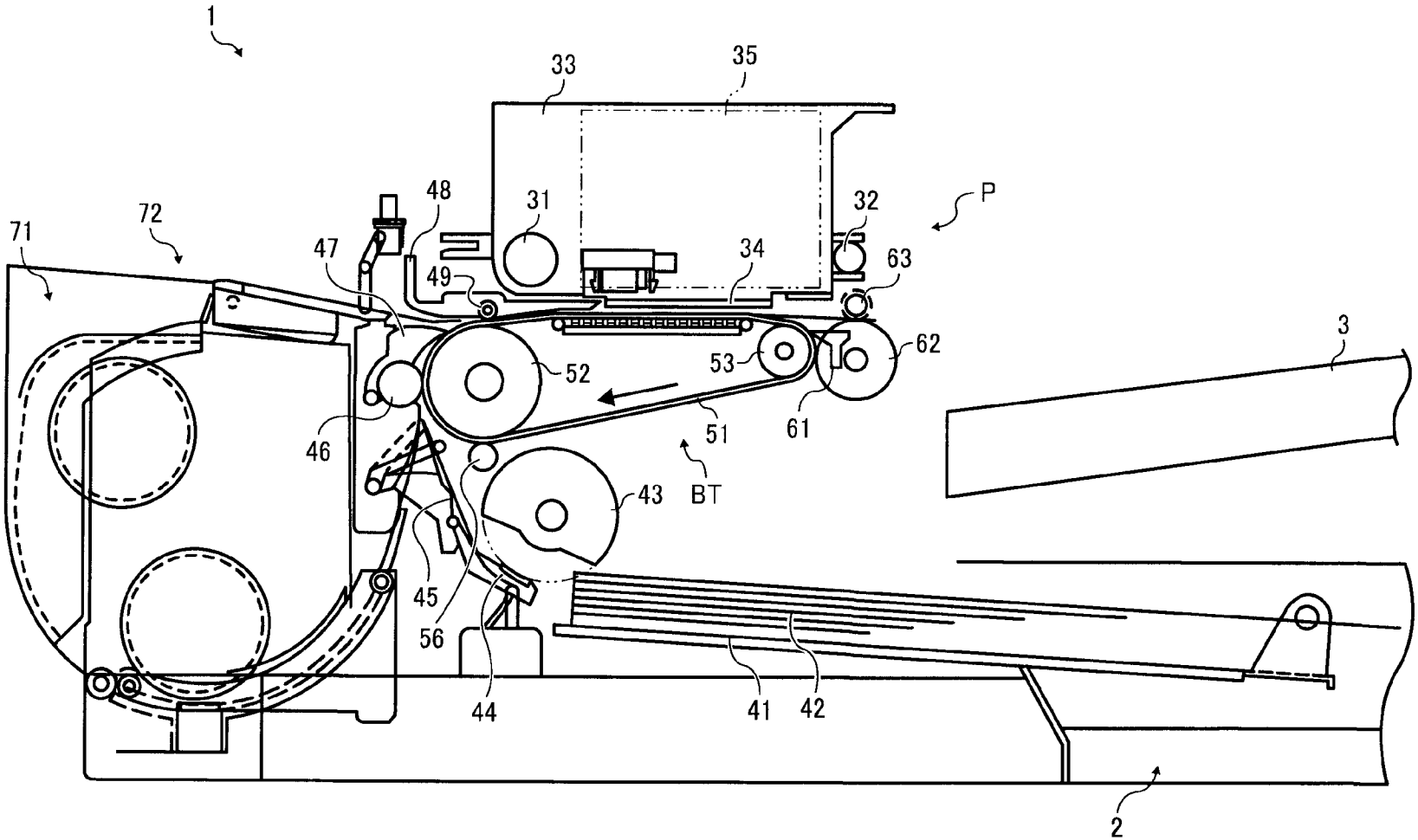
FIG. 1 is a schematic diagram illustrating a general arrangement of an image forming apparatus according to this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, examples and exemplary embodiments of this disclosure are described.

In the following discussion, the term "image" includes any visual representation of objects, including text, graphics, pictures, design, and artwork, either concrete or abstract, and the term "image formation", "imaging", or "printing" refers to production of images on recording media, including, but not limited to, paper, thread, yarn, textiles, leather, metal, plastic, glass, wood, ceramic, etc. The term "image forming apparatus" used herein refers to any system capable of producing images with marking material, particularly to those that perform image formation by ejecting droplets of ink onto recording media. The term "ink" is not limited to conventional inks, but includes any liquid that can be used for image formation as set forth herein.

FIG. 1 is a schematic diagram illustrating a general arrangement of an image forming apparatus 1 according to this patent specification.

As shown in FIG. 1, the image forming apparatus 1 includes a belt transport unit BT, a printing unit P, and various mechanical components working in cooperation to print an image on a recording medium or recording sheet.

The belt transport unit BT includes an endless transport belt 51 with a roller assembly 48 having a pressure roller 49 and a leading roller 50, not shown, and a charge roller 56 disposed in contact with an outer surface of the transport belt 51. The transport belt 51 is supported under tension around a drive roller 52 and a tension roller 53, which define a travel path along which the transport belt 51 moves in a direction of arrow. The transport belt 51 serves to convey a recording sheet on the outer surface throughout the printing process.

The printing unit P is located adjacent to the belt transport unit BT, and includes a carriage 33 supported by guide rods 31 and 32 with print heads 34*ck* and 34*ym* (indicated collectively by numeral 34) and ink tanks 35*ck* and 35*ym* (indicated collectively by numeral 35) mounted therein. The carriage 33 serves to print an ink image by ejecting droplets of ink onto a recording sheet in a serial process.

At a lower side of the apparatus 1, a sheet tray 2 is provided to hold a stack of recording sheets 42 on a bottom board 41, with a pickup roller 43, a separator pad 44 formed of high friction material and pressed against the pickup roller 43, a guide plate 45, a counter roller 46, and an edge guide 47 connecting the sheet tray 2 to the belt transport unit BT.

At one side of the belt transport unit BT, an output tray 3 is provided to receive recording sheets after printing. A sheet separator 61, an ejection roller 62, and a spur 63 are disposed to output each recording sheet from the belt transport unit BT to the output tray 3.

At another side of the belt transport unit BT, a sheet reversing unit 71 with a manual feed tray 72 is releasably mounted on a back side of the apparatus. The sheet reversing unit 71 serves to invert a recording sheet for re-feeding to the belt transport unit BT in duplex mode printing.

During operation, the recording sheets 42 are fed one by one with the pickup roller 43 and the separator pad 44. Each fed sheet is substantially vertically oriented, guided along the guide plate 45 to an entrance nip defined between the counter roller 46 and the drive roller 52, and enters the belt transport unit BT.

In the belt transport unit BT, the transport belt 51 moves along the travel path as the supporting rollers 52 and 53 rotate. The charge roller 56, in contact with the outer surface of the moving transport belt 51, electrostatically charges the belt surface, where positively and negatively charged areas of uniform size alternately appear along the length of the transport belt 51. This recurring pattern of electric charges are created by applying an alternating voltage, i.e., a voltage with polarity switching between negative and positive over time, to the charge roller 56 which rotates upon movement of the transport belt 51.

The outer surface of the transport belt 51 is made of insulating material with no charge control agent added, such as polymers including polyethylene terephthalate (PET), polyethylene isophthalate (PEI), polyvinylidene fluoride (PVDF), polycarbonate (PC), ethylene tetrafluoroethylene (ETFE), and polytetrafluoroethylene (PTFE) or elastomers. The transport belt 51 may have one or more inner layers in addition to the outermost insulating layer, in which case the additional layers may include conductive material of polymer or elastomer containing carbon.

The recording sheet reaching the entrance nip is attracted to the charged surface of the transport belt 51 with a leading edge thereof guided by the edge guide 47 and pressed against the belt surface by the roller assembly 48. As the transport belt 51 rotates, the recording sheet is turned substantially 90 degrees and forwarded to a print zone, i.e., beneath the printing unit P, in a substantially flat position. The recording sheet entering the print zone receives an ink image created by the printing unit P as will be described later in more detail.

After the printing process, the transport belt 51 further advances the recording sheet to exit the belt transport unit BT, where the recording sheet is stripped from the transport belt 51 by the sheet separator 61, and ejected from the belt transport unit BT by the ejection roller 62 and the spur 63 downward to the output tray 3.

When duplex printing is intended, the transport belt 51 rotates in the opposite direction to introduce the recording sheet into the sheet reversing unit 71. The sheet reversing unit 71 turns over the incoming sheet for re-feeding to the belt transport unit BT via the entrance nip, and the same process is repeated to print images on opposite sides of the recording sheet.

Figure 2A:
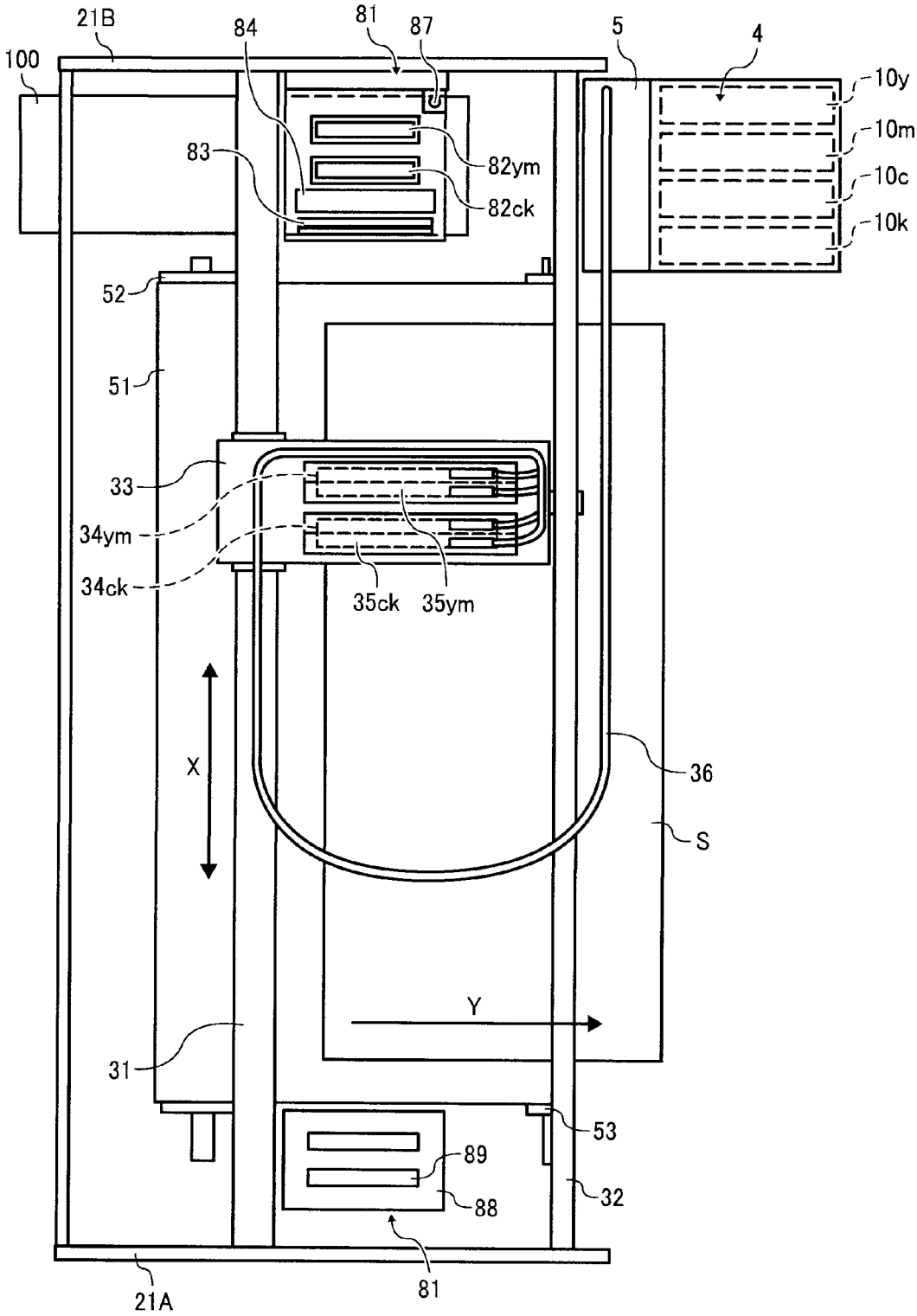
FIGS. 2A and 2B are enlarged top and side plan views, respectively, schematically illustrating a printing unit and a belt transport unit of the image forming apparatus of FIG. 1.
Figure 2B:
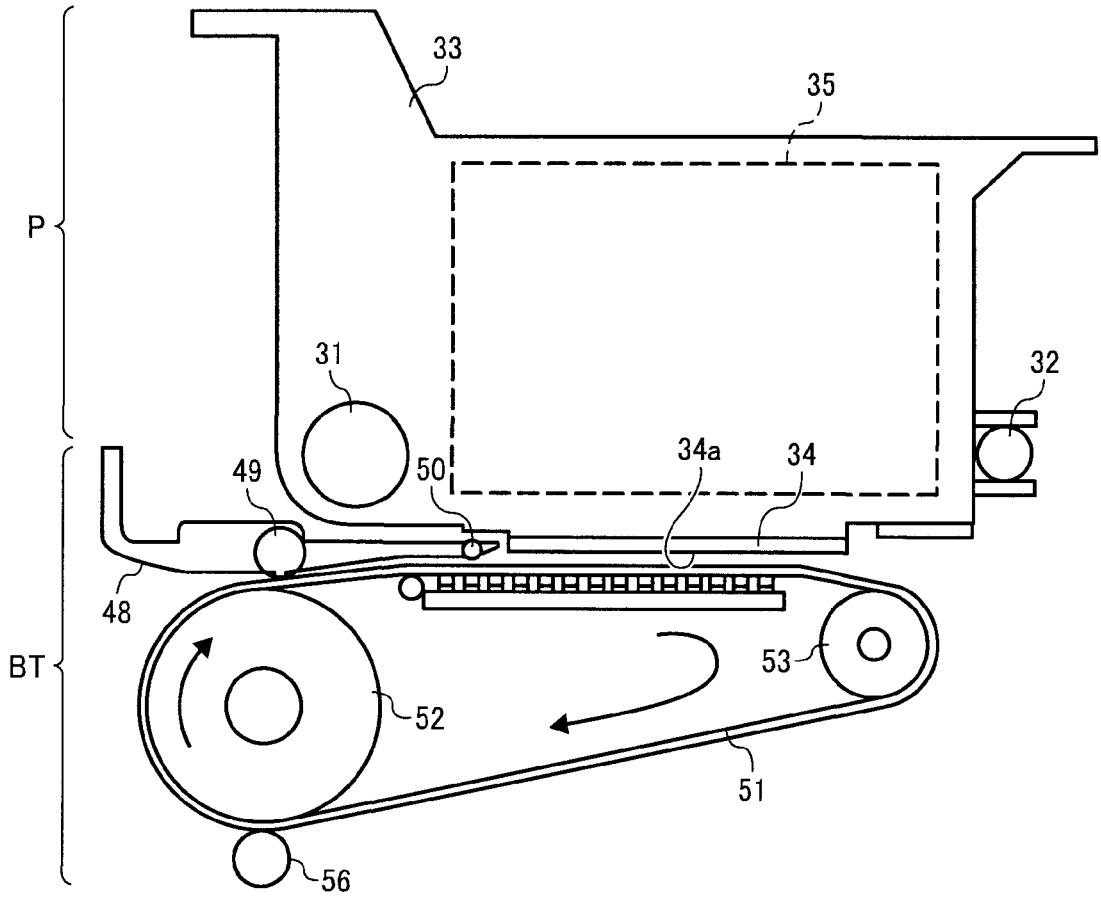

FIGS. 2A and 2B are enlarged top and side views, respectively, schematically illustrating the printing unit P and the belt transport unit BT of the image forming apparatus 1.

As shown in FIGS. 2A and 2B, the guide rods 31 and 32 supporting the carriage 33 extend between side walls 21A and 21B of the apparatus body, defining therealong a main scan axis or direction X in which the carriage 33 moves reciprocally back and forth when driven by a main scan motor via a timing belt, not shown. The transport belt 51 runs beneath the carriage 33, and moves in a sub-scan direction Y perpendicular to the main scan direction X when driven by a sub-scan motor, not shown.

In the carriage 33, the print heads 34*ym* and 34*ck* each has multiple nozzles, not shown, to eject droplets of ink downward from a nozzle face 34*a*. The print head 34*ym* includes two arrays of nozzles parallel to the sub-scan direction Y, one for yellow ink and the other for magenta ink. Similarly, the print head 34*ck* includes two nozzle arrays parallel to the sub-scan direction Y, one for cyan ink and the other for black ink. The ink tanks 35*ym* and 35*ck* are provided to supply ink of a particular color to each corresponding print head.

Each ink tank 35 is connected to a corresponding one of ink cartridges 10*y*, 10*m*, 10*c*, and 10*k* detachably loaded in a cartridge holder 4, from which ink is supplied to the ink tank 35 via a supply tube 36 aided by a motor-driven pump 5.

In addition, the printing unit P includes a maintenance station 81 located at opposite ends of the main scan axis X. The maintenance station 81 includes nozzle caps 82*ck* and 82*ym*, a wiper blade 83, a first spittoon 84 integrated with a cleaner member 85 and a blade cleaner 86, not shown, and a carriage lock 87, all located at one side of the print zone. The maintenance station 81 also includes a second spittoon 88 with openings 89 parallel to the nozzle arrays, located at the opposite side of the print zone.

In operation, the carriage 33 traverses the print zone along the main scan direction X in a reciprocating motion while activating the print head 34 to form an image according to the image data. At the same time, the transport belt 51 conveys a recording sheet S in the print zone along the sub-scan direction Y in a stepped motion.

Namely, the print head 34 on the carriage 33 moving one end to another ejects ink droplets onto the recording sheet S while the transport belt 51 is at rest. When one swath of ink image is created, the transport belt 51 advances the recording sheet S by a given amount and stops. The print head 34 then forms another swath of ink image in a succeeding portion of the recording sheet S, and such a process is repeated until an end signal is transmitted and/or until a trailing end of the sheet reaches the print zone.

After printing, the carriage 33 moves aside the print zone to an initial position in which the nozzle face 34*a* meets the maintenance station 81, and rests in the initial position anchored by the carriage lock 87. The maintenance station 81 performs various maintenance/recovery procedures to maintain and recover a proper condition of the nozzles and ensure reliable performance of the print head 34. Such procedures include sucking nozzles clear with the nozzle caps 82*ck* and 82*ym*, wiping the nozzle face 34*a* with the wiper blade 83, firing the nozzles to discharge dried viscous ink into the first spittoon 84, removing ink residues accumulated on the wiper blade 83 by applying the cleaner member 85 with the blade cleaner 86, etc. The recovery procedure may also be performed during printing, where the nozzles are fired to discharge dried viscous ink into the second spittoon 88 beside the print zone.

Figure 3:
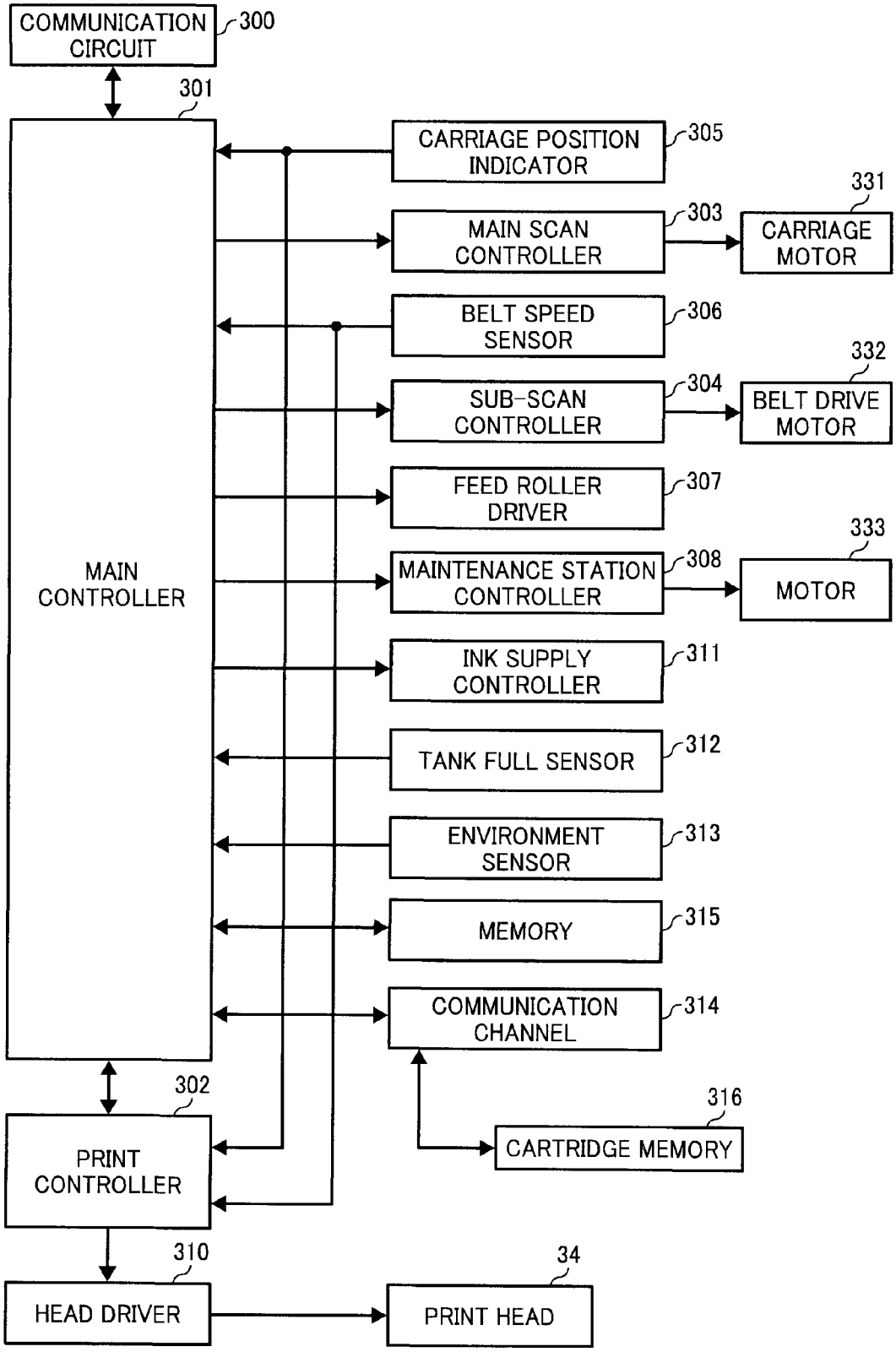
FIG. 3 is a block diagram illustrating control circuitry of the image forming apparatus of FIG. 1.

Referring to FIG. 3, a block diagram illustrating control circuitry of the image forming apparatus 1 is described.

As shown in FIG. 3, the control circuitry includes a main controller 301 and a print controller 302 communicating with various electronic circuits and elements used in the image forming apparatus 1.

In the image forming apparatus 1, the main controller 301 is connected to a carriage motor 331 via a main scan controller 303, a belt drive motor 332 via a sub-scan controller 304, and a motor 333 via a maintenance station controller 308. The main controller is also connected to a carriage position indicator 305, a belt speed sensor 306, a feed roller driver 307, an ink supply controller 311, a tank full sensor 312, and an environment sensor 313. The main controller 301 has a dedicated memory 315 and may access a cartridge memory 316 via a communication channel 314.

The print controller 302 is connected to the print head 34 via a head driver 310 as well as the main controller 301, the cartridge position indicator 305, and the belt speed sensor 306.

The main controller 301 and the print controller 302 each is implemented using a common microprocessor. As is well known, a microprocessor includes an internal timer capable of measuring elapsed time even during power-off. The memory 315 is implemented using a non-volatile memory such as electrically erasable programmable read-only memory (EEPROM). The cartridge memory 316 is non-volatile and dedicated to each ink cartridge 10 of the printing unit P.

In the control circuitry, the main controller 301 outputs instructions to the main scan controller 303 and a sub-scan controller 304 according to information input from the communication circuit 300, the carriage position indicator 305, and the belt speed sensor 306, while transmitting print data to the print controller 302. The main scan controller 303 and the sub-scan controller 304 then activate the carriage motor 331 and the belt drive motor 332 to move the carriage 33 and the drive roller 52 in a coordinated manner during the printing process described above.

The carriage position indicator 305 outputs a detection signal to the main controller 301, indicating speed and position of the carriage 33 moving along the main scan direction X. Such position information may be obtained, for example, by counting the number of slits of a linear encoder arranged in the main scan direction X with a photosensor mounted on the moving carriage 33. According to the carriage position information, the main controller 301 directs the main scan controller 303 to drive or rotate the carriage motor 331 so that the carriage 33 moves to a desired location at a desired speed along the main scan axis.

The belt speed sensor 306 outputs a detection signal to the main controller 301, indicating speed and position of the transport belt 51 moving along the sub-scan direction Y. Such speed information may be obtained, for example, by counting the number of slits of a rotary encoder mounted on the rotation axis of the drive roller 52 with a photosensor. According to the belt speed information, the main controller 301 directs the sub-scan controller 304 to drive or rotate the belt drive motor 332 so that the transport belt 51 moves to a desired location at a desired speed along the travel path.

In addition, the main controller 301 directs the feed roller driver 307 to turn the feed roller 43 to feed a recording sheet. The main controller 301 also directs the maintenance station controller 308 to activate the motor 333, which in turn enables the maintenance station 81 to perform a given maintenance/recovery procedure as described above.

The main controller 301 receives a signal from the tank full sensor 311, notifying when the ink tank 35 is full. Based on notification by the tank full sensor 311, the main controller 301 directs the ink supply controller 311 to supply ink from the ink cartridge 10 to the ink tank 35 with the pump 5 driven by a motor, not shown.

The main controller 301 also receives a signal from the environment sensor 313, indicating environmental conditions, such as ambient temperature and relative humidity, under which the image forming apparatus 1 is operating.

The main controller 301 retrieves information from the cartridge memory 316 via the communication channel 314 for processing, and stores processed information in the dedicated memory 315 for later retrieval.

In the control circuitry, the print controller 302 receives the print data from the main controller 301 and the detection signals from the carriage position indicator 305 and the belt speed sensor 306. According to the received information, the print controller 302 generates image data used to form an ink image by selectively actuating the nozzles of the print head 34 with a suitable pressure generator, such as piezoelectric actuators.

The print controller 302 transmits the image data to the head driver 310 in serial form, together with a clock signal, a latch signal, and a control or mask signal used for the transmission and/or reception of the serial data.

The print controller 302 also provides the head driver 310 with a waveform drive signal containing multiple pulse trains each formed of identical or different pulses, generated from patterns of drive signals stored in read-only memory (ROM) in digital form. In generating a drive signal, each digital pattern is converted to analog data by a digital-to-analog converter, and processed into an appropriate pulse signal using a voltage or current amplifier. The generated pulse signal is input to an output circuit, which selects an appropriate pulse signal according to the image data and forwards the selected pulses as a waveform to the head driver 310.

The head driver 310 selectively applies the waveform drive signal to actuators of the print head nozzles, which then eject droplets line by line according to the serially transmitted image data. The waveform signal with the selective pulses enables the nozzles to eject droplets of different sizes, thus forming an ink image with ink dots of variable sizes.

Having described the general features of the image forming apparatus 1, a detailed description is now given of belt shape correction performed by the image forming apparatus according to this patent specification.

Figure 4A:
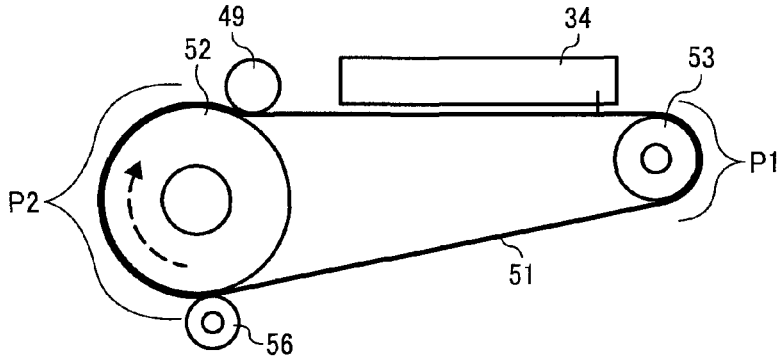
FIGS. 4A and 4B are schematic diagrams illustrating deformation of a transport belt in the belt transport unit.
Figure 4B:
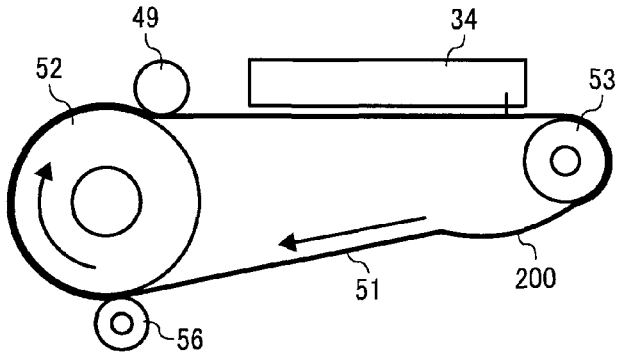

FIGS. 4A and 4B are schematic diagrams illustrating the belt transport unit BT of the image forming apparatus 1.

As mentioned above, the belt transport unit BT includes the endless transport belt 51 made of a flexible material or member, and trained under tension around the drive roller 52 and the tension roller 53. Tensioning the transport belt ensures good flatness of recording sheets conveyed thereon, and the flexible material enables smooth belt rotation and prevents the transport belt from wrinkling or bending.

With reference to FIG. 4A, the two rollers 52 and 53 supporting the transport belt 51 have different diameters depending on the specific functions, where the tension roller 53 adding tension to the supported belt is smaller in diameter than the drive roller 52 imparting rotational movement to the transport mechanism. The relatively small size of the tension roller 53 prevents undue stress on the transport belt 51 while effecting self-stripping of sheets at the exit from the belt transport unit BT.

In such a configuration, the transport belt 51 held in the tensioned state has a portion P1 in continuous contact with the tension roller 53. When the transport belt 51 remains stationary for extended time periods, the portion P1 eventually conforms to the roller contour, which appears as an arch-shaped deformation 200 when the transport belt 51 starts rotation as shown in FIG. 4B. While not depicted in the drawing, a similar deformation may also occur at a portion P2 of the transport belt 51 maintained in contact with the drive roller 52 for a certain period of time.

Figure 5:
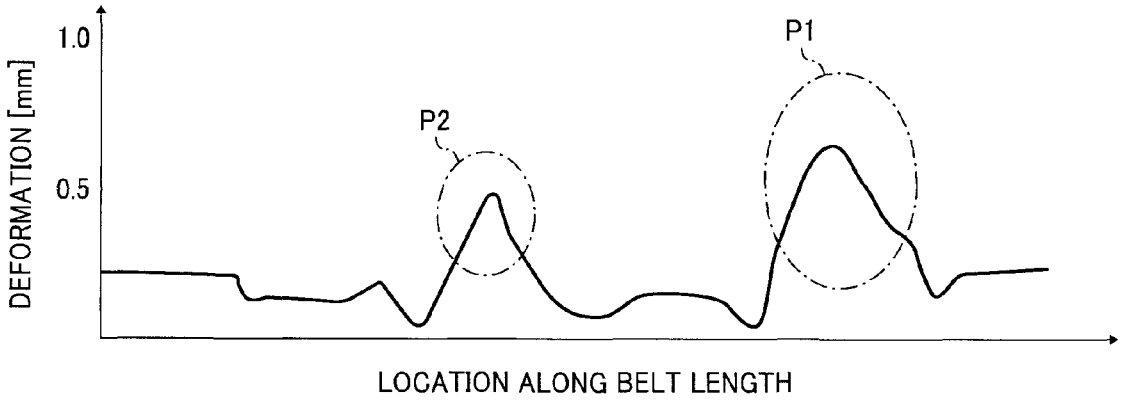
FIG. 5 shows measurements showing amount of belt deformation plotted against length of a transport belt.

FIG. 5 shows measurements showing the amount of belt deformation plotted against the length of the transport belt 51. In FIG. 5, and also in the following description, the deformation amount is defined as displacement of the belt surface from a given base plane, measured dynamically by rotating the belt along the travel path. The measurement was performed on the transport belt held stationary around the two supporting rollers for 600 minutes at 20° C. and 50% relative humidity.

As shown in FIG. 5, the portions P1 and P2 retained in contact with the tension roller 53 and the drive roller 52, respectively, suffered larger deformation compared to the other areas remaining separate from the roller surfaces. Particularly, the deformation of the portion P1 was severer than that of the portion P2. The data demonstrates that continuous contact with the supporting rollers causes local deformation of the transport belt, and that the tension roller which is relatively small in diameter and thus large in curvature tends to cause larger deformation than the other roller used in conjunction to support the belt.

Figure 6A:
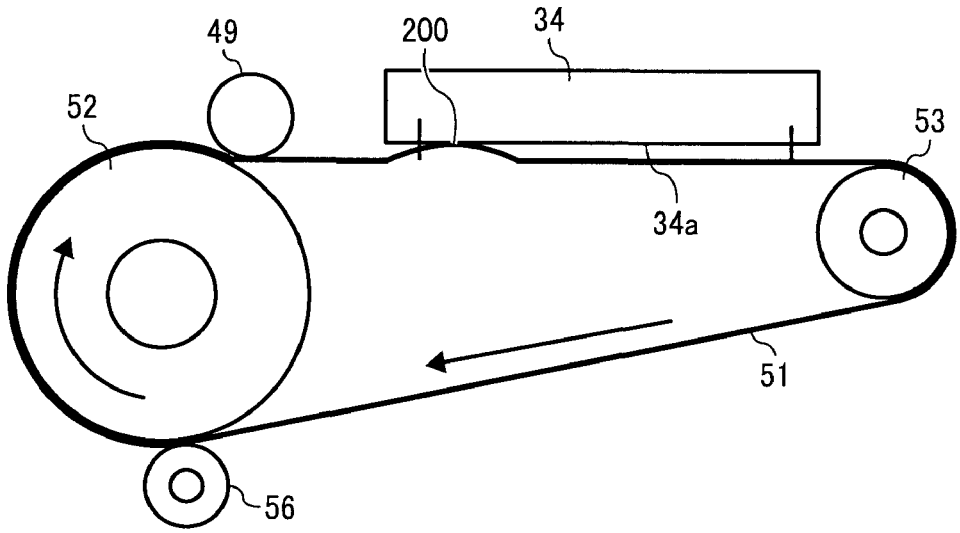
FIGS. 6A and 6B illustrate possible defects caused by a relatively large deformation of the transport belt.
Figure 6B:
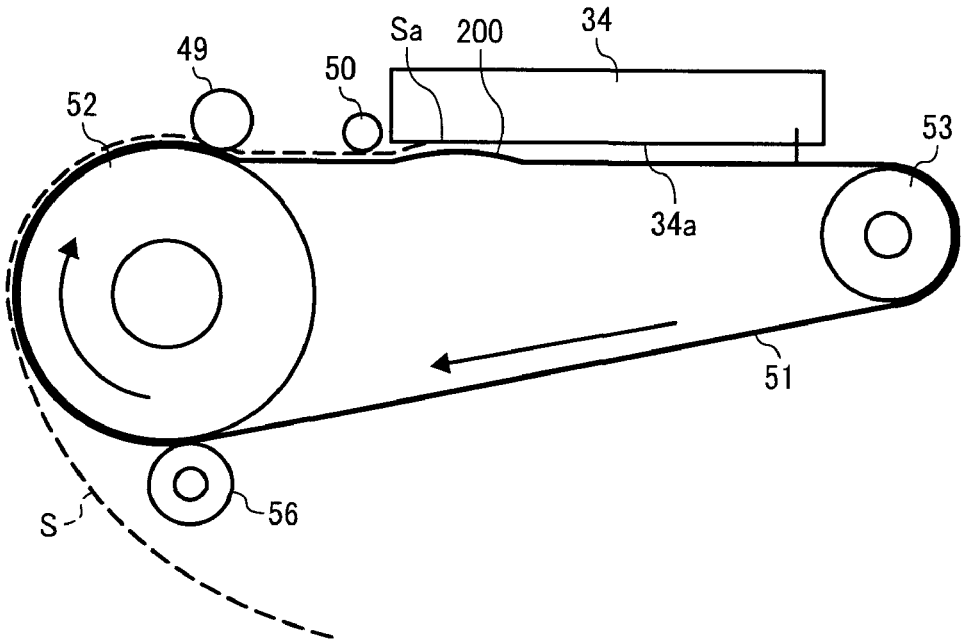

Such arch-shaped deformation of the transport belt leads to malfunctioning of the inkjet printing system. With reference to FIGS. 6A and 6B, consider a case in which a relatively large deformation enters a small gap (such as about 1 millimeter) defined between the print head and the travel path in the print zone of the image forming apparatus 1.

As shown in FIG. 6A, the deformation 200 reaching the print zone can directly interfere with the nozzle face 34*a* of the print head 34. Moreover, as shown in FIG. 6B, conveying a recording sheet S on the deformed surface 200 can cause a sheet jam due to a leading edge Sa of the conveyed sheet S interfering with the nozzle face 34*a*. The interference between the sheet edge and the nozzle face tends to occur particularly when the recording sheet S is pressed by the leading roller 50 before entrance to the print zone, causing the leading edge Sa on the deformation 200 to point toward the nozzle face 34*a*.

The image forming apparatus 1 according to this patent specification effectively corrects such local deformation of the transport belt through use of roller pressure and/or by controlling belt movement prior to printing.

Figure 7:
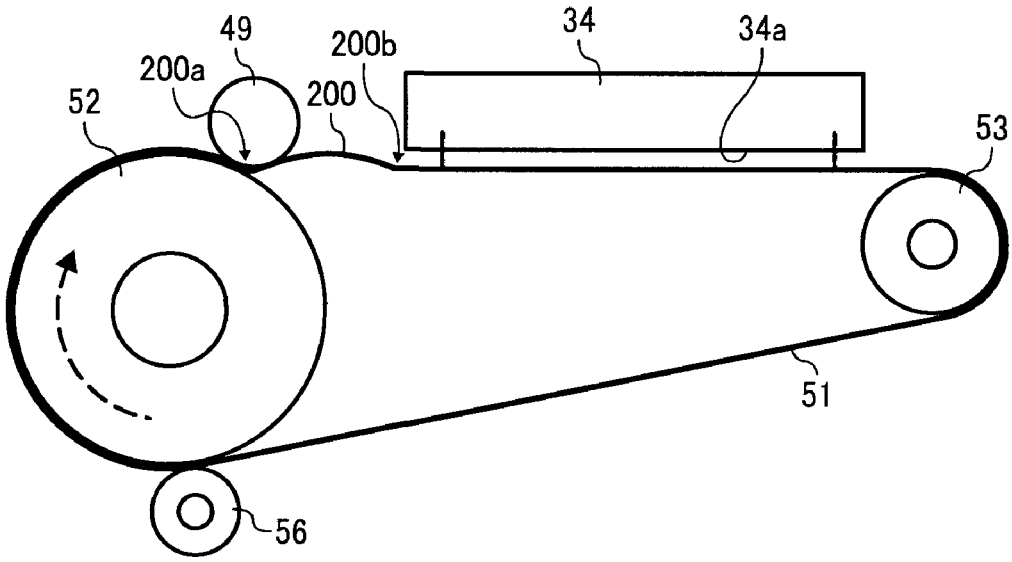
FIG. 7 is a schematic diagram illustrating an exemplary embodiment of the belt shape correction according to this patent specification.
Figure 8:
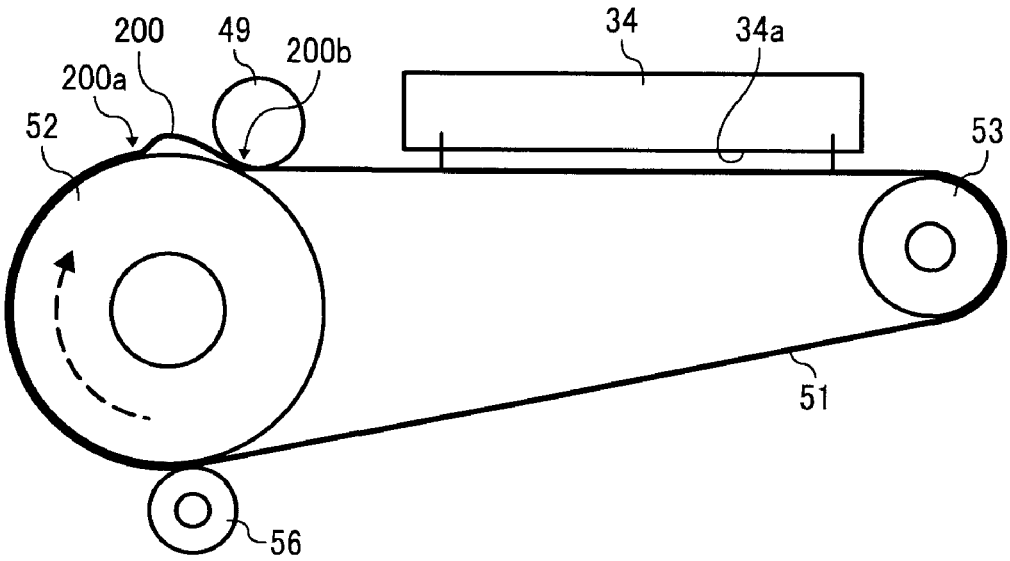
FIG. 8 illustrates a schematic diagram illustrating an undesirable state of the belt transport unit.

Referring to FIG. 7, a schematic diagram illustrating an exemplary embodiment of the belt shape correction according to this patent specification is described.

In this embodiment, the image forming apparatus 1 moves the transport belt 51 along the travel path into a correcting position as shown in FIG. 7, in which the portion 200, previously retained in contact with the supporting roller and thus deformed into an arch, meets the pressure roller 49 pressing against the outer surface of the transport belt 51. The transport belt 51 is held stationary in this correcting position for a given period of time tc, during which the downward pressure exerted by the pressure roller 49 flattens the arch of the deformation 200.

Specifically, the transport belt 51 moves from its previous position to the correcting position by a distance Lt given by either of the following expressions:

$$Lt=n*Lc+L1 \quad (1)$$

$$Lt=n*Lc+L2 \quad (2)$$

where "n" is a given integer, "Lc" is a circumference of the belt travel path, "L1" is a distance between the tension roller 53 and the pressure roller 49 along the travel path, and "L2" is a distance between the drive roller 52 and the pressure roller 49 along the travel path. The roller-to-roller distances L1 and L2 each may be defined as a minimum distance from a nip defined between the supporting roller and its contiguous roller to a nip defined between the pressure roller 49 and a given surface contiguous thereto.

Preferably, the correcting position is located so that the flattening pressure is applied to an upstream side 200*a* of the deformation 200. Pressing the upstream side 200*a* avoids an extra strain on the deformed surface in the belt shape correction procedure, which would be caused by pressing a downstream side 200*b* of the deformation 200 as shown in FIG. B.

The above belt shape correction procedure is advantageous in that the belt deformation is directly treated with the flattening pressure of the pressure roller, which effectively restores the deformed part of the transport belt to a normal shape.

Figure 9:
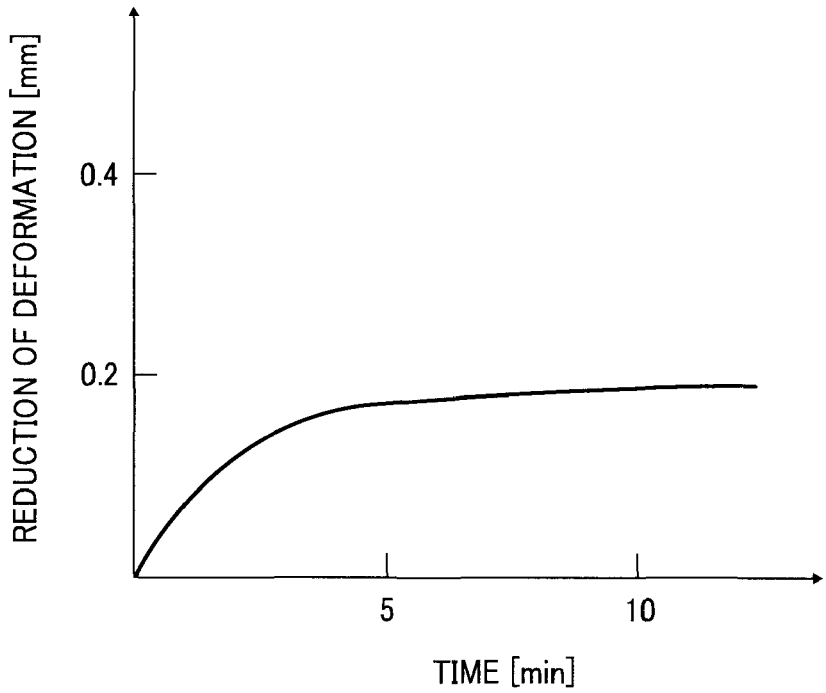
FIG. 9 shows an exemplary curve representing the reduction in deformation amount achieved by the belt shape correction of FIG. 7.

FIG. 9 shows an exemplary curve representing the reduction in deformation amount achieved by this belt shape correction procedure, plotted against the time period during which the correcting position is maintained. According to a study performed, a 0.1 to 0.5 mm reduction in the belt deformation is achieved when the deformed belt is held in the correcting position for 1 minute.

By performing the belt shape correction procedure, the image forming apparatus 1 reliably maintains good flatness of the transport belt and of recording sheets conveyed on the transport belt. This prevents unwanted interference on the print head and concomitant degradation of the ink ejecting performance, thereby ensuring good imaging quality of the image forming apparatus 1.

In order for the belt shape correction procedure to be applied effectively and reliably, the image forming apparatus 1 may be arranged to determine whether or not to perform the belt shape correction based on various factors influencing the amount of deformation induced in the transport belt 51.

Figure 10:
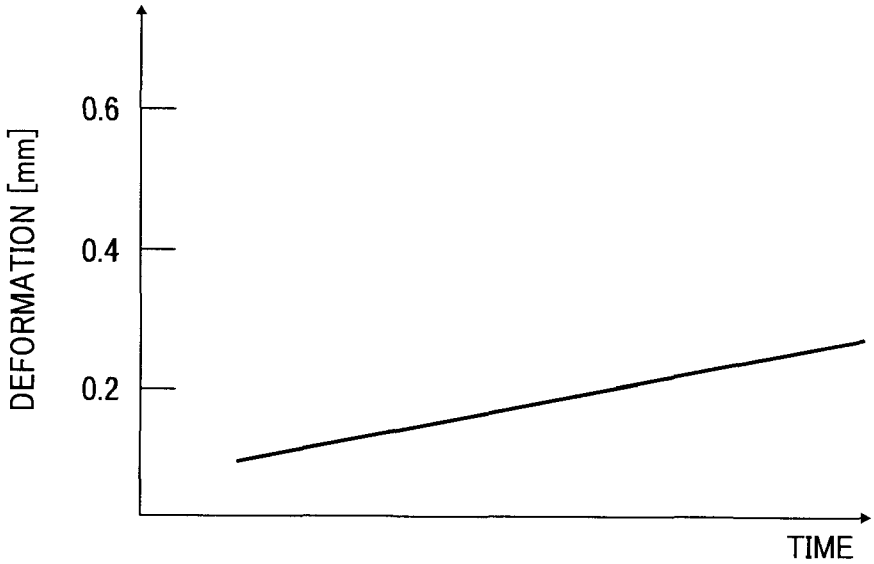
FIG. 10 is a plot showing a deformation amount increasing with idle time of the transport belt.

One factor that may affect the deformation amount is the period of time during which the transport belt 51 remains stationary and idle in the tensioned state. As shown in FIG. 10, the deformation amount increases with the idle time of the transport belt 51.

In one arrangement, the image forming apparatus 1 performs the belt shape correction when the belt idle time exceeds a given reference time.

Another possible factor affecting the deformation amount is environmental conditions under which the transport belt 51 is used. Since the elasticity of the belt material changes with ambient temperature and humidity, these environmental parameters have an influence not only on the deformation amount of the transport belt 51 but also on the period of time required to flatten the deformed portion through the belt shape correction procedure.

In another arrangement, the image forming apparatus 1 performs the belt shape correction when the environmental conditions are such as to increase the deformation amount. Alternatively, the image forming apparatus 1 may vary the time period during which to maintain the transport belt 51 in the correcting position depending on the environmental conditions.

Further, the image forming apparatus 1 may perform the correction procedure before printing concurrently with the maintenance/recovery operation in the maintenance station 81 described hereinabove. As shown in Table 1 below, a specific time period is required when the maintenance station 81 performs each maintenance or recovery procedure, including cleaning or refreshing the nozzles to ensure proper performance of the print head ("HEAD CLEANING" and "HEAD REFRESHING"), supplying ink to the ink tank as needed for printing ("INK SUPPLY"), replenishing the ink tank by pumping ink from the cartridge ("INK REPLENISHMENT"), and sensing the ink level of the ink tank for proper replenishment or supply of ink ("INK LEVEL SENSING"). On the other hand, the belt shape correction requires a certain period of time to hold the transport belt 51 in the correcting position. Thus, performing the belt shape correction procedure concurrently with the maintenance/recovery operation allows printing to start without taking much time for the preparatory process, which enhances time efficiency and productivity of the image forming apparatus 1.

TABLE 1

Time required for maintenance and recovery of the print head

| | INK LEVEL SENSING | HEAD CLEANING | INK REPLENISHMENT | HEAD REFRESHING | INK SUPPLY |
|---|---|---|---|---|---|
| TIME (sec) | 20 | 90 | 180 | 200 | 250 |

Figure 11:
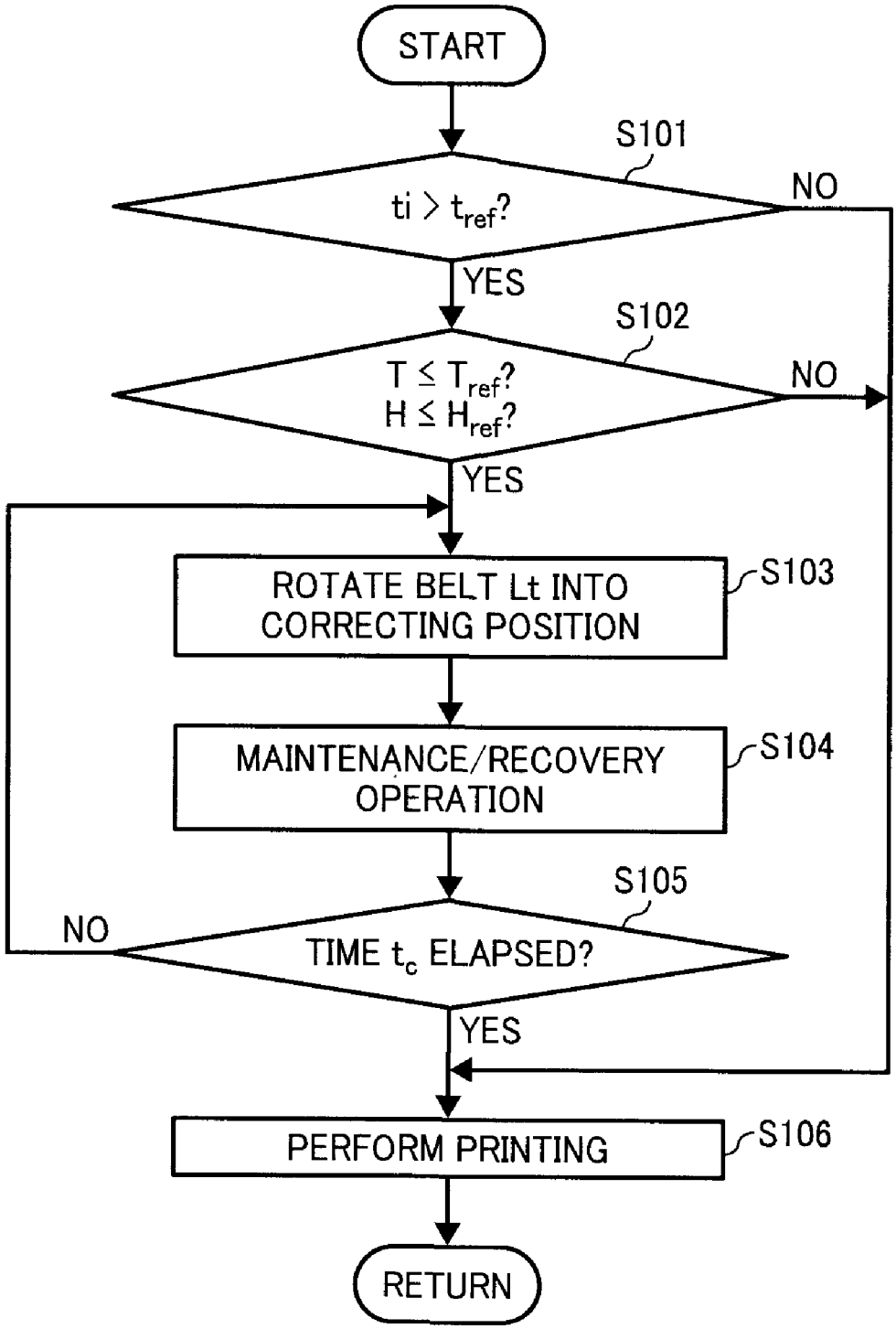
FIG. 11 is a flowchart illustrating an example of a belt shape correction method based on the embodiment of FIG. 7.

FIG. 11 is a flowchart illustrating an example of a belt shape correction method using the belt shape correction procedure of FIG. 7.

Initially, e.g., upon power-up, the main controller 301 determines a period of time ti during which the transport belt 51 remains idle and stationary and judges whether or not the idle time ti exceeds a given reference time tref (S101).

When ti>tref ("YES" in S101), the main controller 301 determines whether or not to perform the belt shape correction procedure based on environmental conditions, such as whether the ambient temperature Ts exceeds a reference temperature Tref of 20° C. and whether the relative humidity Hs exceeds a reference humidity of 50% (S102).

When Ts≦Tref and Hs≦Href ("YES" in S102), the main controller 301 rotates the transport belt 51 by the given distance Lt and holds the transport belt 51 in the correcting position as shown in FIG. 7 (S103).

During the time the transport belt 51 is held stationary, the main controller 301 directs the maintenance station 81 to perform a given operation to recover and prime the print head 34 for printing (S104).

The main controller 301 determines whether or not a given time tc has elapsed since the transport belt 51 is set in the correcting position, and if so ("YES" in S105), directs the printer components to perform printing (S106). As well, when ti≦tref ("NO" in S101), or when Ts>Tref and Hs>Href ("NO" in S102), printing is started without performing the belt shape correction procedure.

According to the belt correcting method described in FIG. 11, the image forming apparatus 1 can correct local deformation of the transport belt before printing. This provides consistent flatness of a recording sheet in the print zone, which reduces the risk of sheet misalignment and improper placement of ink droplets, thereby achieving excellent imaging quality of the image forming apparatus 1.

Figure 12:
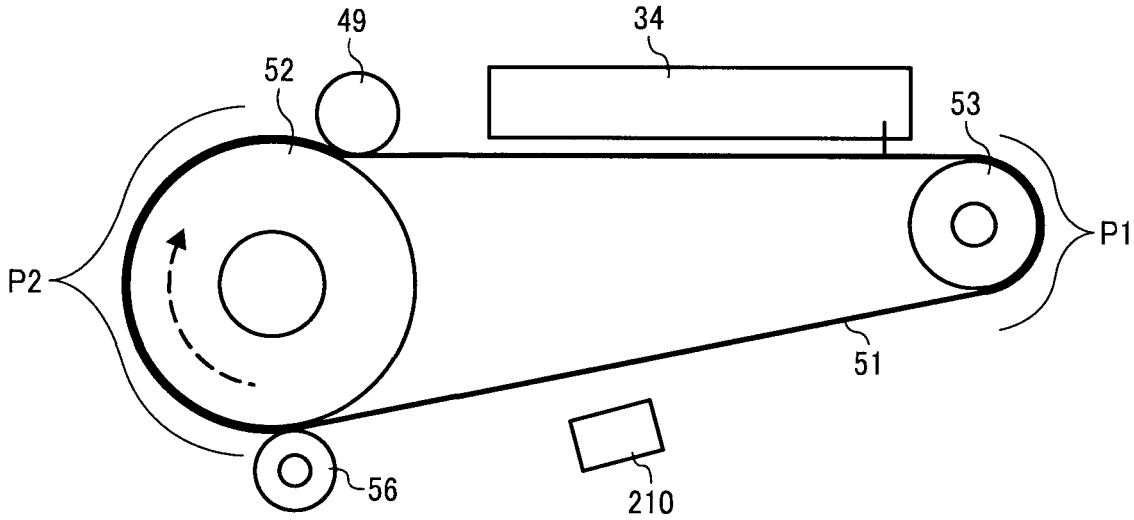
FIG. 12 is a schematic diagram illustrating another exemplary embodiment of the belt shape correction according to this patent specification.

FIG. 12 is a schematic diagram illustrating another exemplary embodiment of the belt shape correction according to this patent specification.

As shown in FIG. 12, this exemplary embodiment is similar to that depicted in FIG. 7, except that a sensor 210 is provided where the transport belt 51 travels past the tension roller 53 toward the drive roller 52. In use, the sensor 210 monitors the condition of the transport belt 51 rotating in the travel path to detect the amount of deformation at the portion retained in contact with the supporting roller. Depending on the deformation amount detected by the sensor 210, the image forming apparatus 1 determines whether or not to perform the belt shape correction procedure described hereinabove.

Figure 13:
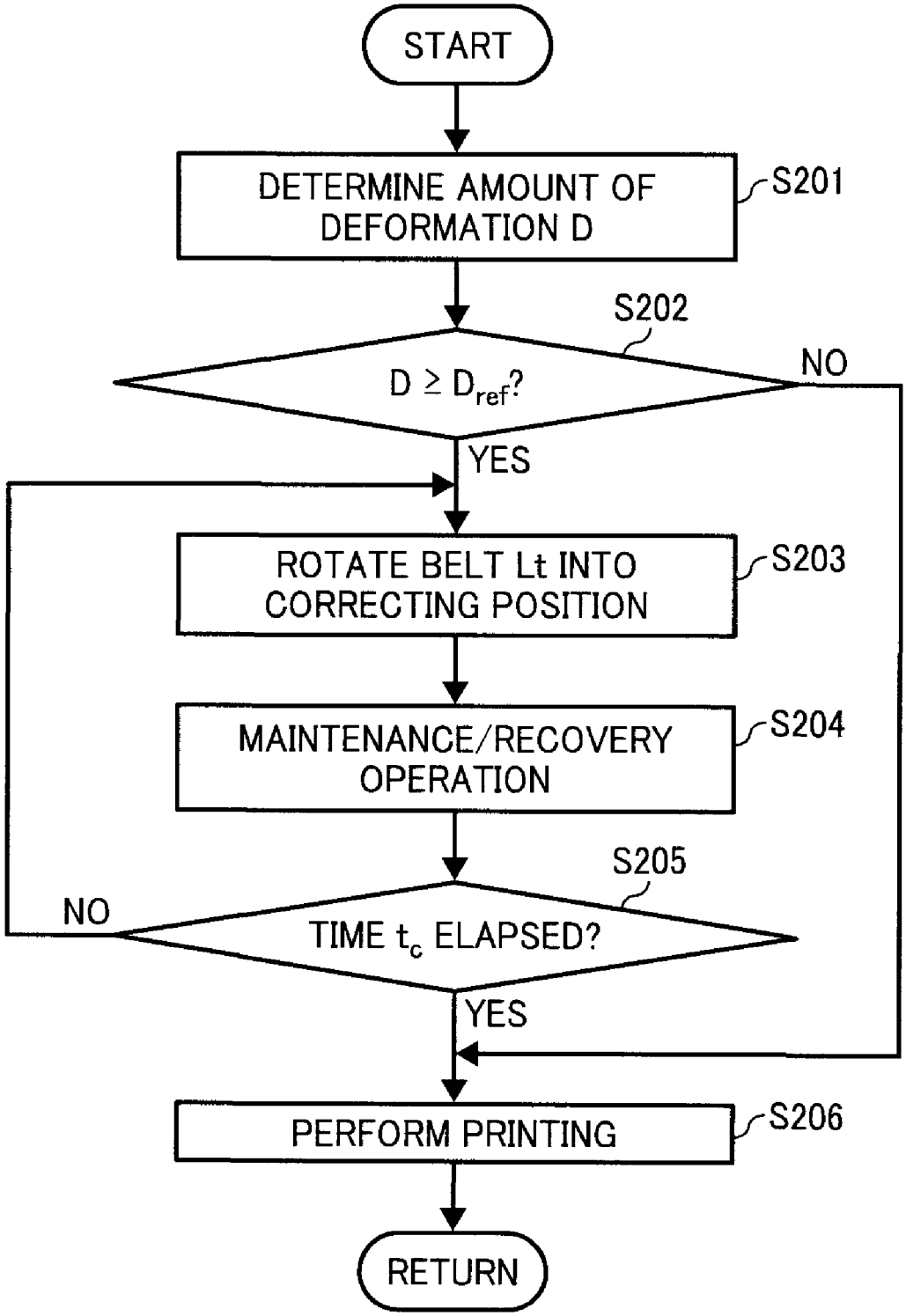
FIG. 13 is a flowchart illustrating another example of a belt shape correction method based on the embodiment of FIG. 12.

FIG. 13 is a flowchart illustrating an example of the belt shape correction method provided with the sensor 210 detecting the deformation amount.

Initially, e.g., upon power-up, the main controller 301 rotates the transport belt 51 to detect an amount of deformation D with the sensor 210 (S201), and compares the detected amount D with a given reference amount Dref, for example, 0.4 millimeters (S202).

When D≧Dref ("YES" in S202), the main controller 301 rotates the transport belt 51 by the given distance Lt and holds the transport belt 51 in the correcting position as shown in FIG. 7 (S203).

During the time the transport belt 51 is held stationary, the main controller 301 directs the maintenance station 81 to perform a given operation to recover and prime the print head 34 for printing (S204).

The main controller 301 determines whether or not a given time tc has elapsed since the transport belt 51 is set in the correcting position, and if so ("YES" in S205), directs the printer components to perform printing (S206). As well, when D<Dref ("NO" in S202), printing is started without performing the belt shape correction procedure.

According to the belt correcting method described in FIG. 13, the image forming apparatus 1 can correct local deformation of the transport belt before printing with consistent flatness of a recording sheet in the print zone, which reduces the risk of sheet misalignment and improper placement of ink droplets. Further, the use of the sensor 210 enables the belt shape correction procedure to be applied efficiently, thereby achieving excellent imaging quality of the image forming apparatus 1 without sacrificing productivity.

In the embodiments discussed above, the image forming apparatus 1 corrects local deformation of the transport belt 51 with flattening pressure of the pressure roller 49 regardless of whether the deformation is severe or moderate. According to a further embodiment, the image forming apparatus 1 is provided with a secondary belt shape correction procedure in addition to the roller-based primary belt shape correction procedure, so as to select either one of the belt shape correction procedures depending on the degree of deformation induced in the transport belt 51.

Specifically, the secondary belt shape correction procedure corrects a deformation of the transport belt 51 by rotating the transport belt 51 a given distance lt along the travel path so as to locate the deformed portion in the vicinity of a supporting roller.

For example, given that the supporting roller has a radius R and forms a nip with its contiguous roller, a belt portion deformed at the roller nip is located within 2n*R both sides of the roller nip when the transport belt 51 travels the given distance lt. In such cases, the distance lt is determined by any of the following expressions:

$$n*Lc-2n*R1<lt<n*Lc \quad (3)$$

$$n*Lc<lt<n*Lc+2n*R1 \quad (4)$$

$$n*Lc-2n*R2<lt<n*Lc \quad (5)$$

$$n*Lc<lt<n*Lc+2n*R2 \quad (6)$$

where "n" is a given integer, "Lc" is a circumference of the travel path, "R1" is a radius of the drive roller 52, and "R2" is a radius of the tension roller 53.

Alternatively, the deformation may be located within 2n*R both sides of a roller nip other than the original roller nip when the transport belt 51 travels the given distance lt. In such cases, the distance lt is determined by any of the following expressions:

$$n*Lc+Lr1-2n*R2<lt<n*Lc+Lr1 \quad (7)$$

$$n*Lc+Lr1<lt<n*Lc+Lr1+2n*R2 \quad (8)$$

$$n*Lc+Lr2-2n*R1<lt<n*Lc+Lr2 \quad (9)$$

$$n*Lc+Lr2<lt<n*Lc+Lr2+2n*R1 \quad (10)$$

where "n" is a given integer, "Lc" is a circumference of the travel path, "Lr1" is a distance from the drive roller 52 to the tension roller 53 along the travel path, "Lr2" is a distance from the tension roller 53 to the drive roller 52 along the travel path, "R1" is the radius of the drive roller 52, and "R2" is the radius of the tension roller 53. The roller-to-roller distances Lr1 and Lr2 each may be defined as a minimum distance from a nip defined between the supporting roller and its contiguous roller to a nip defined between the other supporting roller and its contiguous roller.

The above belt shape correction procedure is based on the fact that the transport belt 51 has elasticity owing to the nature of the belt material as mentioned above, and therefore tends to maintain its original shape or length when stretched to a certain degree. Thus, when a portion of the transport belt 51 extends or stretches out at a nip defined between a supporting roller and its contiguous roller, belt portions adjacent to the extending portion change shape so that the overall length of the transport belt 51 does not exceed a given maximum limit under normal operating conditions. Consequently, positioning an existing deformation of the transport belt 51 in the vicinity of the supporting roller, i.e., where the transport belt 51 is extended, allows the deformed part to return to its original shape.

It has been experimentally shown that holding a deformed portion of the transport belt in the vicinity of the supporting roller for 1 minute effects an approximately 0.1-mm reduction in the amount of deformation, and a similar effect is observed in the measurement data of FIG. 5, where areas on both sides of the portions P1 and P2 have surface displacement lower than that of other areas.

In application, the image forming apparatus 1 uses this secondary procedure to correct relatively moderate deformation, and the primary roller-based procedure for relatively severe deformation. The degree of deformation may be determined based on the deformation amount detected by the sensor, or based on the idle time during which the transport belt is held stationary under tension.

Figure 14:
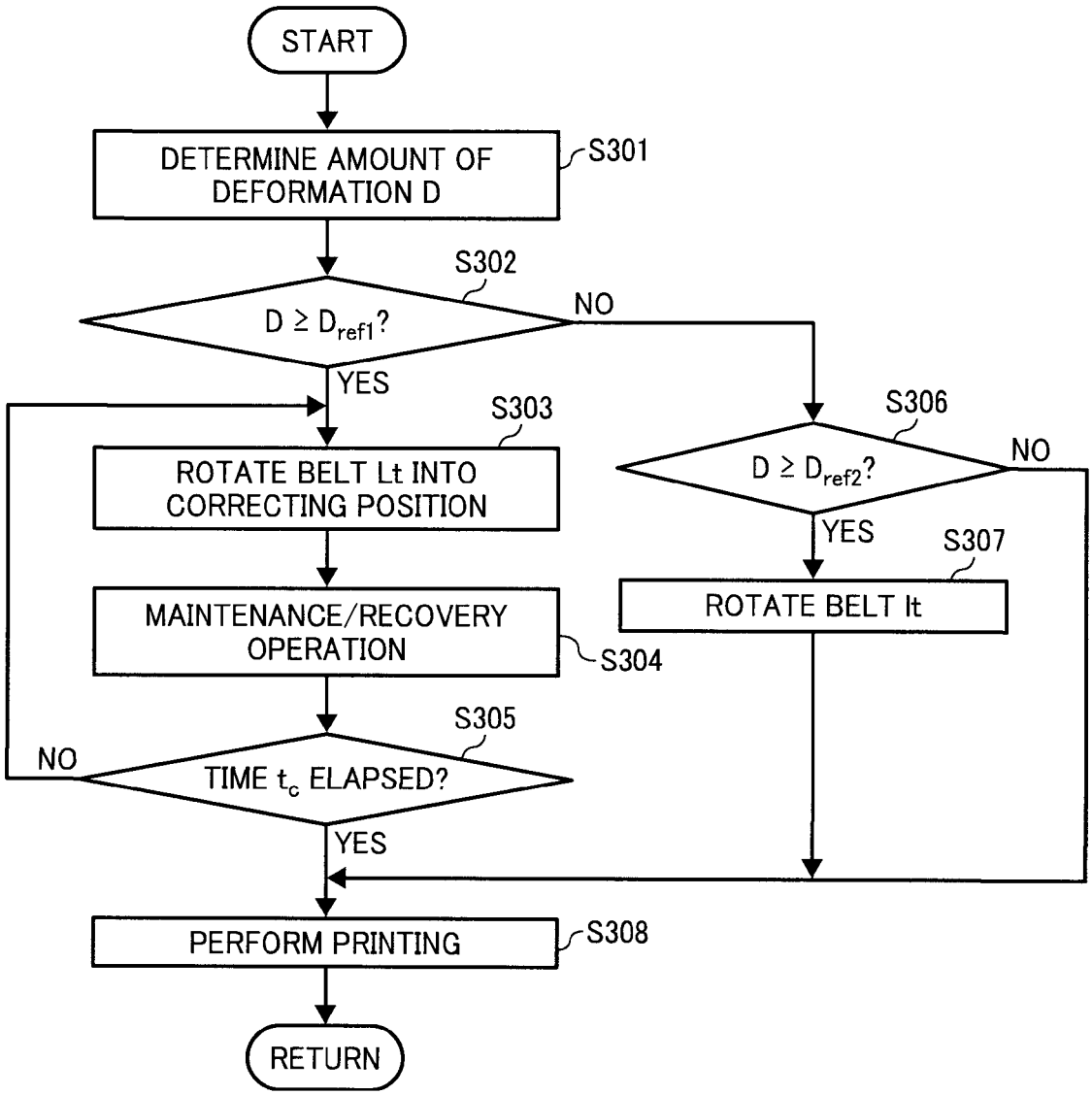
FIG. 14 is a flowchart illustrating still another example of the belt shape correction method.

FIG. 14 is a flowchart illustrating an example of the belt shape correction method provided with the selectable belt shape correction procedures.

Initially, e.g., upon power-up, the main controller 301 rotates the transport belt 51 to detect an amount of deformation D with the sensor 210 (S301), and compares the detected amount D with a given reference amount Dref1 (S302).

When D≧Dref1 ("YES" in S302), the main controller 301 rotates the transport belt 51 by the given distance Lt and holds the transport belt 51 in the correcting position as shown in FIG. 7 (S303). Then, the operation proceeds in a manner similar to that illustrated in FIG. 13 (S303 through S305).

When D<Dref1 ("NO" in S302), the main controller 301 compares the detected amount D with a given reference amount Dref2 (S306). When D≧Dref2 ("YES" in S306), the main controller 301 performs the secondary belt shape correction procedure, rotating the transport belt 51 by the given distance lt (S307).

Upon completion of the secondary belt shape correction procedure, or when a given time tc has elapsed since the transport belt 51 is set in the correcting position ("YES" in S305), the main controller 301 directs the printer components to perform printing (S308). As well, when D<Dref2 ("NO" in S306), printing is started without performing the belt shape correction procedures.

As mentioned, while the illustrated example determines the degree of deformation based on the sensor 201 detecting the deformation amount, the belt shape correction method with the selectable belt shape correction procedures is applicable to the embodiment as depicted in FIG. 11, in which the degree of deformation is determined based on the period of time during which the transport belt 51 remains idle and stationary.

According to the belt correcting method described in FIG. 14, the image forming apparatus 1 can correct local deformation of the transport belt before printing with consistent flatness of a recording sheet in the print zone, which reduces the risk of sheet misalignment and improper placement of ink droplets. Further, the selectable belt shape correction procedures increase efficiency of the belt shape correction, thereby achieving excellent imaging quality of the image forming apparatus 1 without sacrificing productivity.

Thus, the image forming apparatus 1 according to this patent specification achieves excellent imaging performance by correcting local deformation of the transport belt. Although the belt shape correction procedure effectively removes the belt deformation, there may be occasions where printing is to be performed without performing the belt shape correction, or where the belt shape correction is shortened by setting a shorter time during which the belt is held in the correcting position and/or a shorter distance by which the belt is rotated for correction.

Figure 15A:
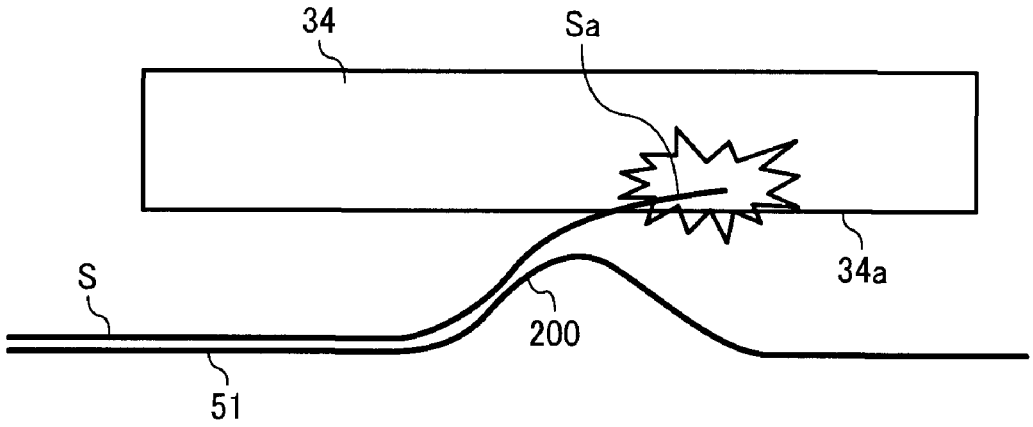
FIGS. 15A and 15B illustrate undesirable interference between a recording sheet and a print head due to belt deformation.
Figure 15B:
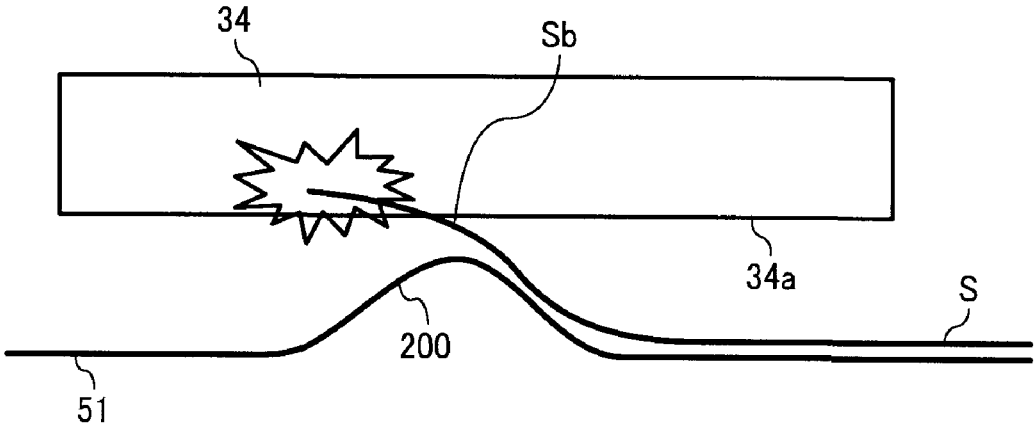

As mentioned, conveying a recording sheet on a deformed portion of the transport belt in the inkjet printing process leads to undesirable interference between the conveyed sheet and the print head. Referring to FIGS. 15A and 15B, consider cases in which the recording sheet S enters the print zone with a leading end Sa or a trailing end Sb resting on the arch of the deformation 200. As shown in the drawings, both cases result in undesirable contact between the recording sheet S and the nozzle face 34*a* of the print head 34. Naturally, such interference may degrade imaging performance of the image forming apparatus.

To prevent such unwanted interference from occurring even when the transport belt 51 has deformation not removed or corrected, the image forming apparatus 1 is designed so that the leading and trailing ends Sa and Sb, particularly where first and last scan lines are drawn, not meet a belt portion previously retained in contact with the supporting roller when introduced to the belt transport unit TB.

Specifically, the belt transport unit TB of the image forming apparatus 1 is designed with the transport belt 51, the supporting rollers 52 and 53, and the entrance of the travel path appropriately sized and positioned with respect to each other so as to locate the belt portion previously retained in contact with the supporting roller away from the leading and trailing ends Sa and Sb of the recording sheet S entering the travel path. The "leading end Sa" and the "trailing end Sb" here each refers to a portion extending from an upstream or downstream edge of a recording sheet, respectively, and proper transport was achieved by setting length or extent of the sheet ends Sa and Sb to 40 millimeters for standard copy paper and to 60 millimeters for thicker paper such as gloss-coated paper.

Alternatively, the belt transport unit BT of the image forming apparatus 1 may be designed to move the transport belt 51 by a given distance before printing so as to position the belt portions previously retained in contact with the supporting rollers away from the leading and trailing ends Sa and Sb of the recording sheet S entering the travel path. Such alternative approach is suitable when it is difficult to adjust the size and position of mechanical components of the belt transport unit BT due to size requirements, etc.

Such positioning operation may be performed with the distance traveled by the transport belt 51 (or the timing at which the feed roller motor is switched on) varied depending on the size of recording sheet, so as to reliably keep the trailing end Sb of the recording sheet away from the intended portion of the transport belt 51.

Advantageously, the positioning operation is arranged so that the belt portion previously retained in contact with the relatively small tension roller 53 is located a given short distance downstream from the leading end Sa of the recording sheet S entering the travel path. Such an arrangement effectively reduces the number of instances where the recording sheet S is introduced onto a deformed portion of the transport belt 51.

Figure 16:
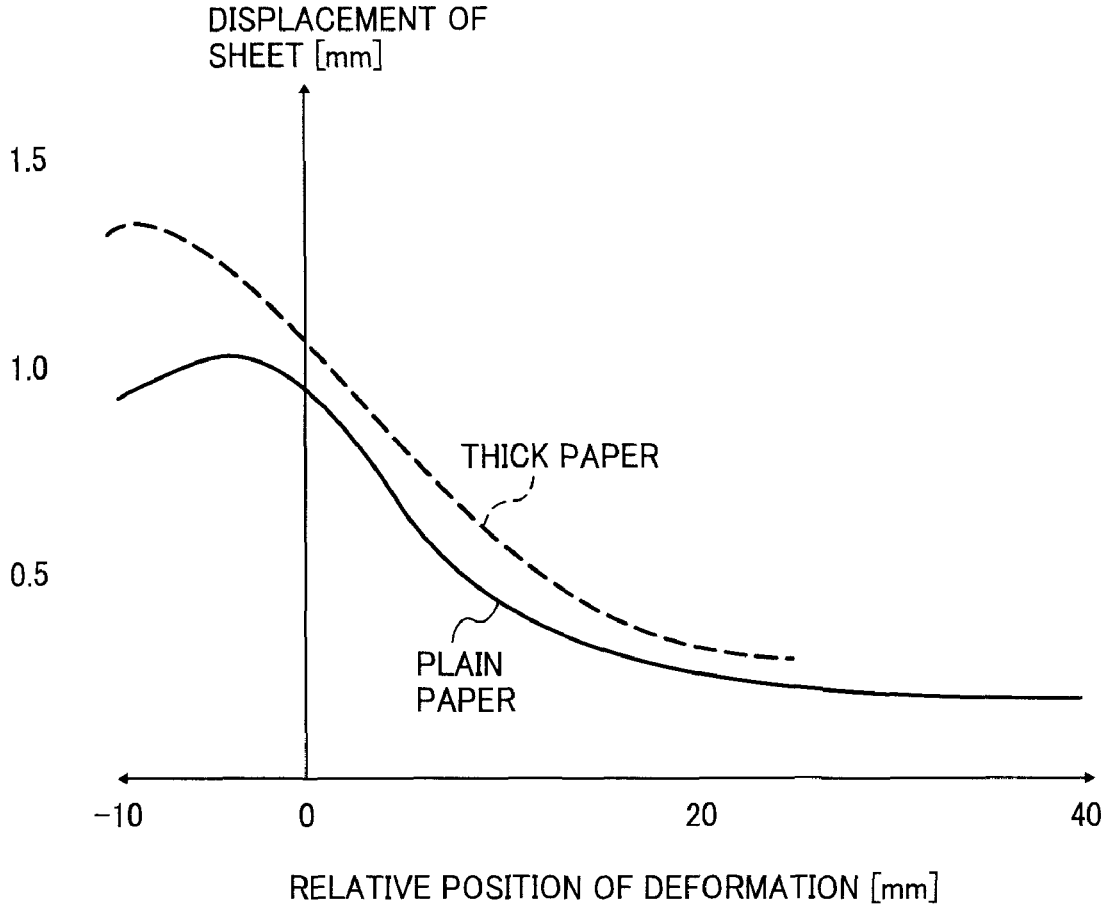
FIG. 16 shows measurements of an amount of displacement by which a recording sheet laid on the locally deformed belt moves away from a given normal position.

FIG. 16 shows measurements of an amount of displacement by which a recording sheet laid on the locally deformed belt moves away from a given normal position. The displacement amount was measured for thick paper and plain copy paper, and plotted against the position of the deformation relative to the leading end of the recording sheet.

As shown in FIG. 16, the sheet displacement is significantly reduced for both types of paper when the deformation is more than 20 millimeters away from the leading end. For a given configuration of the image forming apparatus 1, the 20-mm spacing between the sheet edge and the portion retained in contact with the tension roller 53 is achieved by setting a particular time interval, such as 250 milliseconds, between activation of the transport belt 51 and engagement of the feed roller clutch.

Numerous additional modifications and variations are possible in light of the above teachings. It is therefore to be understood that, within the scope of the appended claims, the disclosure of this patent specification may be practiced otherwise than as specifically described herein. For example, the belt transport according to this patent specification is applicable not only to an inkjet printer but also to an image forming apparatus with multiple imaging capabilities, such as printing, faxing, and copying, as well as to any electronic apparatus using an endless belt for conveying specific material. In addition, while the embodiment disclosed herein employs electrostatic force, any appropriate mechanism, for example, air suction, may be adopted to attract recording sheets onto the belt surface in the belt transport.

This patent specification is based on Japanese patent application, No. JPAP2007-208806 filed on Aug. 10, 2007 in the Japanese Patent Office, the entire contents of which are hereby incorporated by reference herein.

What is claimed is:

1. An image forming apparatus, comprising:

a print head configured to eject droplets of ink from multiple nozzles onto a recording sheet;

an endless belt stretched around at least first and second rollers, and configured to convey the recording sheet placed on an outer surface thereof;

a belt driving unit configured to drive the endless belt;

a pressure roller configured to exert pressure against the outer surface of the endless belt; and a controller configured to determine that a specific portion of the endless belt has been retained in contact with the first roller and has developed a deformation due to said contact with the first roller, the controller controlling the belt driving unit to move the endless belt into a correcting position and hold the endless belt in the correcting position at which the pressure roller meets said specific portion of the endless belt that has been retained in contact with the first roller wherein the pressure exerted by the pressure roller corrects the deformation while the endless belt is held in the correcting position.

2. The image forming apparatus according to claim 1, wherein the pressure is applied to an upstream side of the specific portion when the endless belt is held in the correcting position.

3. The image forming apparatus according to claim 1, wherein the first roller is smaller in diameter than the second roller.

4. The image forming apparatus according to claim 1, further comprising a maintenance station operable to prime the print head for printing, wherein the maintenance station operates while the endless belt is held in the correcting position.

5. The image forming apparatus according to claim 1, wherein the controller determines whether or not to set the specific portion of the endless belt in the correcting position based on a length of a time period during which the endless belt previously remains stationary.

6. The image forming apparatus according to claim 1, wherein the controller determines whether or not to set the specific portion of the endless belt in the correcting position based on any one of a detected ambient temperature and a detected relative humidity under which the endless belt is operated.

7. The image forming apparatus according to claim 1, wherein the controller causes the recording sheet to be placed for conveyance on the endless belt with leading and trailing ends thereof both away from the specific portion of the endless belt.

8. The image forming apparatus according to claim 7, wherein the controller controls the belt driving unit to rotate the endless belt and position the specific portion away from both the leading and trailing ends of the recording sheet to be placed on the endless belt.

9. The image forming apparatus according to claim 8, wherein the controller controls the belt driving unit to rotate the endless belt and position the specific portion downstream of the leading end of the recording sheet to be placed on the endless belt.

10. The image forming apparatus according to claim 1, wherein the controller is configured to determine that the specific portion of the endless belt has developed the deformation by determining that the endless belt has been retained in contact with the first roller for a specific time period.

11. The image forming apparatus according to claim 10, wherein in a case that the controller determines that the endless belt has been retained in contact with the first roller for a second specific time period less than the specific time period, the controller controls the belt driving unit to move the endless belt a predetermined distance such that the specific portion is located proximate to the first roller or second roller.

12. The image forming apparatus according to claim 1, wherein the controller is configured to determine that the specific portion of the endless belt has developed the deformation by determining that a detected ambient temperature exceeds a temperature threshold or a detected humidity level exceeds a humidity threshold.

13. The image forming apparatus according to claim 1, wherein the controller is configured to determine that the specific portion of the endless belt has developed a deformation due to said contact with the first roller based on readings from a deformation sensor.

14. The image forming apparatus according to claim 13, wherein in a case that the controller determines based on readings from the deformation sensor that the deformation is a particular size, the controller controls the belt driving unit to move the endless belt a predetermined distance such that the specific portion is located proximate to the first roller or second roller.

15. The image forming apparatus according to claim 1, wherein the controller controls the belt driving unit to hold the specific portion of the endless belt in the correcting position for a correcting time period.

16. The image forming apparatus according to claim 15, wherein the correcting time period is determined by the controller based on any one of (i) a detected ambient temperature proximate to the endless belt and (ii) a detected humidity level proximate to the endless belt.

17. A method for maintaining an endless belt stretched around first and second rollers of an image forming apparatus, comprising:

determining, by a controller of the image forming apparatus, that a specific portion of the endless belt has been retained in contact with the first roller and has developed a deformation due to said contact with the first roller;

controlling, by the controller, a belt driving unit of the image forming apparatus to move the endless belt into a correcting position and hold the endless belt in the correcting position at which a pressure roller of the image forming apparatus meets said specific portion of the endless belt; and exerting, by the pressure roller, pressure on the specific portion to correct the deformation while the endless belt is held in the correcting position.

* * * * *